US011428502B1

(12) United States Patent
Bentley et al.

(10) Patent No.: US 11,428,502 B1
(45) Date of Patent: Aug. 30, 2022

(54) SELF-SECURING FIREARM HOLSTER AND SELF-SECURING MAGAZINE HOLSTER

(71) Applicant: ADAPTIVE TACTICAL LLC, Nampa, ID (US)

(72) Inventors: James K. Bentley, Eagle, ID (US); Kelly W. Squires, Nampa, ID (US)

(73) Assignee: Adaptive Tactical LLC, Nampa, ID (US)

( * ) Notice: Subject to any disclaimer, the term of this patent is extended or adjusted under 35 U.S.C. 154(b) by 0 days.

(21) Appl. No.: 17/571,881

(22) Filed: Jan. 10, 2022

Related U.S. Application Data

(60) Provisional application No. 63/224,511, filed on Jul. 22, 2021.

(51) Int. Cl.
*F41C 33/02* (2006.01)
*F42B 39/02* (2006.01)

(52) U.S. Cl.
CPC ..... *F41C 33/0263* (2013.01); *F41C 33/0209* (2013.01); *F42B 39/02* (2013.01)

(58) Field of Classification Search
CPC ..... F41C 33/0263; F41C 33/0209; F41C 33/048; F41C 33/02; F41C 33/0272; Y10S 224/911; Y10S 224/912
See application file for complete search history.

(56) References Cited

U.S. PATENT DOCUMENTS 1,148,935 A * 8/1915 Snavely ..... F41C 33/0263 224/911
4,258,871 A * 3/1981 McMahon ..... F41C 33/046 224/192
4,424,924 A * 1/1984 Perkins ..... F41C 33/0227 224/668
4,577,787 A * 3/1986 Hersey ..... F41C 33/041 224/192
4,759,482 A * 7/1988 Olsen ..... F41C 33/0227 224/912
4,785,983 A * 11/1988 DeSantis ..... F41C 33/0227 224/604
5,174,482 A * 12/1992 Rogers ..... F42B 39/02 224/679
5,570,830 A * 11/1996 Nichols ..... F41C 33/0236 224/679
5,622,295 A * 4/1997 Hellweg ..... F41C 33/0236 224/912

(Continued)

*Primary Examiner* — Brian D Nash
(74) *Attorney, Agent, or Firm* — Parsons Behle & Latimer

(57) ABSTRACT

A magazine holster is a unitary body that includes an inner cavity configured to receive a magazine. A firearm holster that is a unitary body that includes an inner cavity configured to receive a firearm. The inner cavity includes a first end and a second end opposite of the first end. The holster includes a first opening into the inner cavity adjacent to the second end of the unitary body and a second opening into the inner cavity adjacent to the second end of the unitary body. The firearm holster includes an internal shoulder positioned within the inner cavity. The unitary body selectively retains a firearm positioned within the inner cavity as a force is applied to the firearm by the internal shoulder. The holster may be an elastomer, a thermoplastic elastomer, ethylene vinyl acetate, rubber, silicon, or a combination thereof. The holster may be comprised of ethyl vinyl acetate.

23 Claims, 11 Drawing Sheets

(56) References Cited

U.S. PATENT DOCUMENTS 5,855,305 A * 1/1999 Nichols ..... F41C 33/0209 224/244
6,050,465 A * 4/2000 Nelson ..... B29C 45/14778 220/62.22
6,085,951 A * 7/2000 Beletsky ..... F41C 33/0263 224/244
6,202,908 B1 * 3/2001 Groover ..... F42B 39/02 224/931
6,769,582 B1 * 8/2004 Beletsky ..... F41C 33/0227 224/244
6,948,644 B1 * 9/2005 Beletsky ..... F41C 33/0227 224/244
7,258,259 B1 * 8/2007 Owens ..... F41C 33/041 224/912
D594,649 S * 6/2009 Zusman ..... D3/222
7,584,875 B2 * 9/2009 Lowe ..... F41C 33/0236 224/912
7,591,402 B2 * 9/2009 Rassias ..... F41C 33/06 224/912
D601,339 S * 10/2009 Zusman ..... D3/222
7,614,534 B2 * 11/2009 Veo ..... G07F 11/16 224/931
7,841,497 B1 * 11/2010 Gregory ..... F41C 33/045 224/912
7,950,553 B2 * 5/2011 Rassias ..... F41C 33/0281 224/912
8,371,487 B1 * 2/2013 Plappert ..... F41C 33/0236 224/587
8,474,670 B1 * 7/2013 Gregory ..... F41C 33/0263 224/912
D749,843 S * 2/2016 Faifer ..... D3/262
9,404,710 B1 * 8/2016 Beard ..... F41C 33/045
9,696,113 B2 * 7/2017 Tedder ..... F41C 33/0263
10,415,927 B1 * 9/2019 Shults ..... F41C 33/0209
10,537,167 B2 * 1/2020 Bryant ..... A45F 5/021
2005/0035163 A1 * 2/2005 French ..... F41C 33/045 224/912
2005/0205621 A1 * 9/2005 Shults ..... F41G 11/003 224/198
2005/0279788 A1 * 12/2005 Lowe ..... F41C 33/0254 224/244
2007/0250980 A1 * 11/2007 Pellerin ..... F41C 33/0209 224/587
2009/0321480 A1 * 12/2009 Kincaid ..... F41C 33/0227 224/269
2013/0193172 A1 * 8/2013 Damkot ..... F41C 33/0209 264/297.4
2014/0097216 A1 * 4/2014 Rogers ..... F41C 33/0227 224/243
2015/0327658 A1 * 11/2015 Swan ..... A45F 3/14 224/660
2016/0102940 A1 * 4/2016 Sykes ..... B32B 27/304 224/587
2016/0238342 A1 * 8/2016 Tedder ..... F41C 33/0263
2017/0115095 A1 * 4/2017 Moultrie ..... F41C 33/048
2017/0191795 A1 * 7/2017 Xia ..... F41C 33/0263
2017/0284755 A1 * 10/2017 Farringer ..... F41C 33/029
2018/0224240 A1 * 8/2018 Sereday ..... F41C 33/0263
2020/0141693 A1 * 5/2020 Rassias ..... F41C 33/041
2020/0386514 A1 * 12/2020 Yeates ..... F41C 33/0218

* cited by examiner

SELF-SECURING FIREARM HOLSTER AND SELF-SECURING MAGAZINE HOLSTER

RELATED APPLICATION

This application claims the benefit of priority under 35 U.S.C. § 119 to U.S. Provisional Patent Application Ser. No. 63/224,511 entitled "SELF-SECURING FIREARM HOLSTER" filed on Jul. 22, 2021, which is incorporated herein in its entirety

FIELD OF THE DISCLOSURE

The embodiments described herein relate to a self-securing firearm holster and a self-securing magazine holster. The firearm holster is of unitary construction and selectively retains a firearm without the use of any moving components. Likewise, magazine holster is of unitary construction and selectively retains a magazine without the use of any moving components.

BACKGROUND

Description of the Related Art

The right to carry a firearm both concealed and in the open is allowed in a majority of the states. The number of citizens that open carry is increasing. When open carrying a firearm there may be a risk that a criminal or ill-willed individual may try to snatch a firearm from an open carry individual, which could be disastrous, if the attempt to obtain the firearm is successful. Sidearms are also routinely worn by hunters or outdoor enthusiasts to provide some potential protection against snakes and/or other predators. A holster or firearm retention device preferably would enable a user to rapidly draw the weapon. However, it is important that the firearm be properly secured so it is not snagged by brush, is dropped if the user falls, becomes loose due to traversal over rough terrain, or the like. An accidental release of a firearm from a holster, or the like, could result in an accidental discharge of the firearm. Holsters made of hard materials may be relatively noisy while going through brush, or the like, which may not be desirable depending on the situation.

Police and military personnel are equipped with a variety of "retention" holsters. Active retention holsters are designed and manufactured by numerous companies and are rated at different levels depending on the number of mechanical locking devices designed into each holster. These holsters are designed to deny access to the firearm to anyone other than the operator and to keep them "holstered" in combat situations. Extensive training and development of muscle memory is required to become proficient in the use of such "retention" holsters. The lives saved by the security provided by active retention holsters is incalculable however the expense of the unit, vulnerability to debris, and the training required to use such holsters safely negates the use of such holsters as being a realistic option for the average firearm owner.

Active retention holsters require a specific action beyond the draw to release the handgun and include moving components to aid in the selective retention and removal of a firearm from the holster. For example, an active retention holster may require the push of a button or include a strap and snap that may be positioned over the end of the firearm to help retain the firearm within the holster. The repeated removal of the firearm may lead to the snap becoming worn and less effective in retaining the firearm. Other types of active retention devices include mechanical locks, trigger guard locks, and thumb loops. Active retention holsters may be a molded holster, which must provide some clearance for the insertion of a firearm. As such, there is often space between the holster walls and the firearm causing the firearm to rattle when the user moves above, which may be negatively viewed by various users such as law enforcement and hunters. Often a user may attempt to modify the holster and/or firearm by adding material such as tape to eliminate a rattle while the firearm is within the holster.

A passive retention holster is a holster that does not employ any moving components mechanical means to hold a firearm in place. Instead, the retention is dependent wholly on the holster design, which is limited at best. In other words, the user needs only pull the gun from the holster. Typically, friction is the chief factor employed in an attempt to retain a firearm in a passive retention holster. While passive retention holsters enable the firearm to be withdrawn without operating any mechanical device, such holsters also allow others to grasp the firearm and easily withdraw it. For all of these reasons, it is important that a holster selectively retains a firearm positioned within the holster until a user intends to extract the firearm.

Other holsters use moving parts in the retention within and removal from of a firearm in a holster. For example, U.S. Pat. No. 7,841,497 entitled "Holster retention system" shows a lever pivotally attached to a side wall of the holster. The lever may be pivotable between an engaged position to selectively retain a firearm and a disengaged position to permit the removal of the firearm. The lever may be biased to be in the engaged position by a biasing mechanism, such as a spring. The repeated movement of the moving parts (i.e., the lever and the spring) may lead to components being worn out and defective. Other disadvantages may exist.

SUMMARY

The present disclosure is directed to a self-securing firearm holster. The firearm holster is of unitary construction and selectively retains a firearm without the use of any moving components. As used herein, components are capable of "moving" when their physical location or position to each other is changed. The use of elastically deformable materials is not considered to be a "moving" component. The unity construction of the holster without the need to use moving components may reduce and/or eliminate the disadvantages discussed above.

One embodiment of the present disclosure is a firearm holster. The firearm holster comprises a unitary body having an inner cavity configured to receive a firearm, the inner cavity having a first end and a second end opposite of the first end. The firearm holster includes a first opening into the inner cavity adjacent to the second end of the unitary body and a second opening into the inner cavity adjacent to the second end of the unitary body. The firearm holster includes an internal shoulder positioned within the inner cavity. The unitary body selectively retains a firearm positioned within the inner cavity, wherein a force is applied to the firearm by the internal shoulder to selectively retain the firearm.

The holster may include a projection that extends from the internal shoulder. The first end of the cavity may be configured to engage a portion of a firearm. The first end of the cavity may be configured to engage a portion of a grip of the firearm and a portion of a slide of the firearm. The first opening may be configured to enable a firearm to be inserted into the inner cavity. The second opening may be configured so a portion of a barrel of a firearm and a portion of the slide both extend through the second opening. The unitary body may be a compressible material. The unitary body may be an elastomer, a thermoplastic elastomer, ethylene vinyl acetate, rubber, silicon, or a combination thereof. The internal shoulder may apply a force to a trigger guard of the firearm. A firearm may be selectively removed from the inner cavity by an application of a force on the firearm toward the internal shoulder and by a rotation of the firearm away from the holster while the force is being applied. The firearm holster may not include moving components.

The holster may be comprised of ethyl vinyl acetate (EVA). The EVA may be cross-linked and have a 50% to 60% proportion of vinyl acetate. The holster may include one or more compression pads positioned adjacent to the inner cavity, wherein the one or more compression pads is configured to apply a force against a slide of a firearm positioned within the inner cavity. The holster may include a fulcrum cushion positioned adjacent to the inner cavity, wherein the fulcrum cushion is configured to apply a force against the slide of the firearm positioned within the inner cavity and provide a pivot point for rotation of the firearm within the inner cavity. The holster may include a trigger guard wall positioned adjacent to the inner cavity and positioned adjacent to the internal shoulder, wherein the trigger guard wall is configured to apply a force against a trigger guard of the firearm positioned within the inner cavity. The holster may include a frame pad positioned adjacent to the inner cavity, wherein the frame pad is configured to apply a force against a frame of the firearm positioned within the inner cavity.

One embodiment of the disclosure is a method of selectively retaining a firearm. The method includes applying a force to a firearm positioned within an inner cavity of a unitary body, wherein an internal shoulder of the unitary body applies the force. The method includes engaging a feature of the firearm with an upper end of the inner cavity to selectively retain the firearm within the inner cavity. The method may include pushing downward on the firearm to deflect the internal shoulder. The method may include pivoting the firearm away from the inner cavity after the upper end of the inner cavity disengages with the feature of the firearm.

One embodiment of the disclosure is a magazine holster. The magazine holster comprises a unitary body having an inner cavity configured to receive a magazine, the inner cavity having a first end and a second end opposite of the first end. The magazine holster includes a first opening into the inner cavity adjacent to the second end of the unitary body and a second opening into the inner cavity adjacent to the second end of the unitary body. The magazine holster includes an internal shoulder positioned within the inner cavity. The unitary body selectively retains a magazine positioned within the inner cavity, wherein a force is applied to the magazine by the internal shoulder to selectively retain the magazine. The unitary body of the magazine holster may be comprised of a compressible material.

Figure 1:
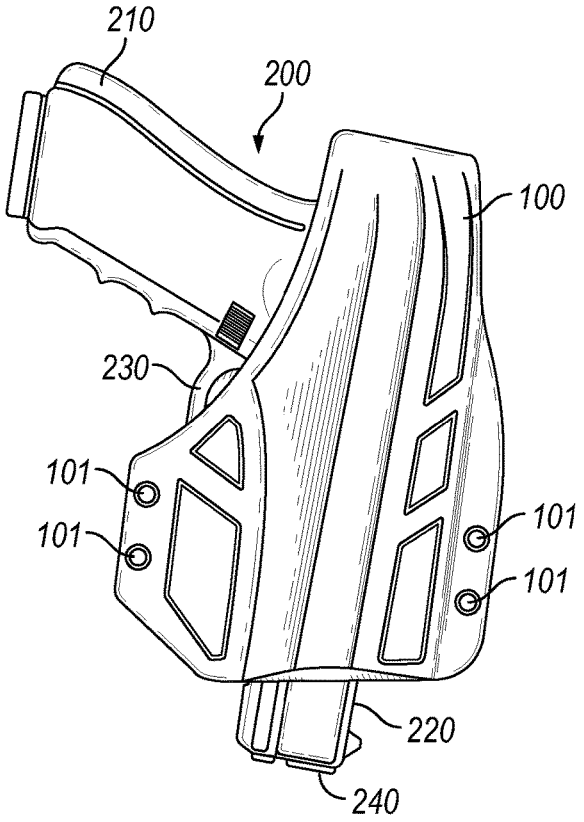
FIG. 1 is a side view of a firearm retained within an embodiment of a holster.

While the disclosure is susceptible to various modifications and alternative forms, specific examples have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

The present disclosure is directed to a "passive-active" retention holster that provides an unparalleled level of security in holsters without the use of complex locking devices as used in typical "active retention" holster. The holster of the present disclosure may be comprised of ethyl vinyl acetate (EVA). The EVA enables a holster design that uses the material itself as a key component in building a simple, effective, strong, durable holster that discourages unwanted access to the firearm and reduces the potential for accidental loss or discharge of a firearm. A holster made of EVA may not generate as much noise when moving through brush, or the like, in comparison to a hard walled holster.

Figure 2:
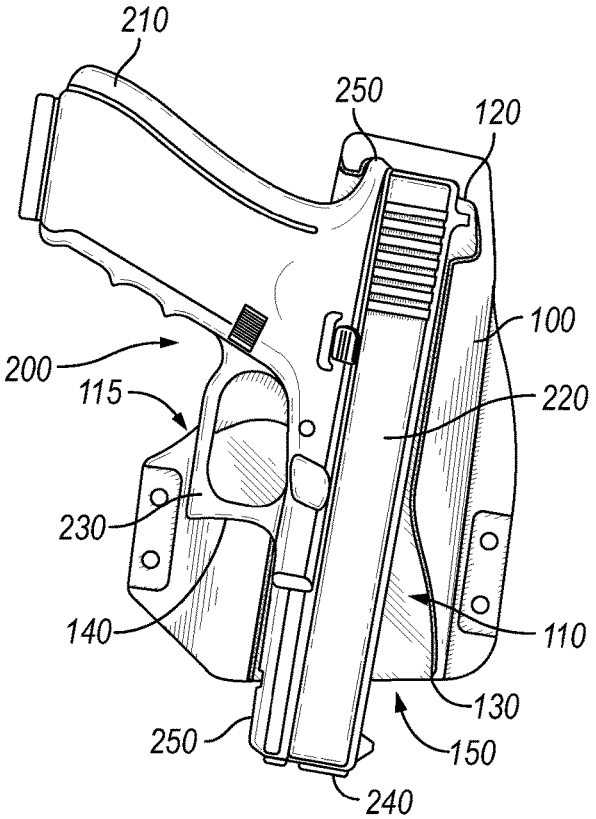
FIG. 2 is a cross-section schematic of a firearm retained within an embodiment of a holster.
Figure 3:
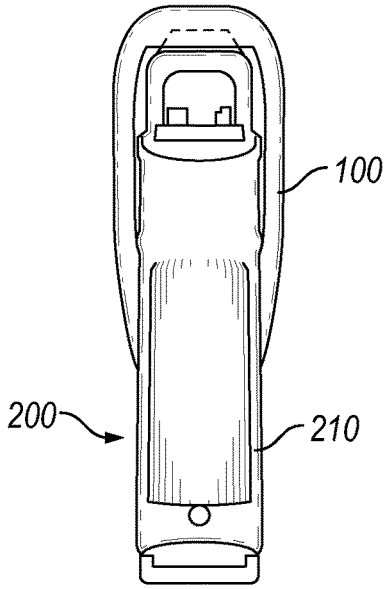
FIG. 3 is a cross-section end view schematic of a firearm retained within an embodiment of a holster.

FIG. 1 is a side view of a firearm 200 selectively retained within a unitary body holster 100. The firearm 200 includes a grip 210, a slide 220, a trigger guard 230, a barrel 240, and a frame 250. The unitary body holster 100 selectively self-retains the firearm 200 within the unitary body holster 100 as discussed herein. FIG. 2 is a cross-section schematic showing a firearm 200 selectively retained within a unitary body holster 100. FIG. 3 is a cross section end view showing a firearm 200 retained within a unitary body holster 100.

The holster 100 is formed of a unitary body and includes an inner cavity 110. The holster 100 includes one or more apertures 101 that enable the holster 100 to be attached to another component, such as but not limited to a belt. The inner cavity 110 includes a first, or upper, end 120 (also referred to herein as a slide cap) and a second, or lower, end 130. The unitary body holster 100 includes a first opening 115 that is generally adjacent to the first end 120 of the inner cavity 110. The first opening 115 is configured to enable a firearm 200 to be inserted into the inner cavity 110 of the unitary body holster 100, starting with the barrel 240. The unitary body holster 100 may include a second opening 150 adjacent to the second end 130 of the inner cavity 110. When the firearm 200 is inserted into the unitary body holster 100, the end of the frame 250 and slide 220 may extend through the second opening 150. The second opening 150 may have a width greater than a width of the end of the frame 250 and slide 220 extending therethrough. The unitary body holster 100 includes an internal shoulder 140. The unitary body holster 100 does not include any separate components. The unitary body holster 100 also does not include any moving components.

The unitary body holster 100 is comprised of a compressible material. As used herein, a compressible material is an elastically deformable material. The compressible material may be an elastomer. For example, the elastomer may be ethylene vinyl acetate ("EVA"), rubber, silicon, or the like, or a combination thereof. In an embodiment, the elastomer may be a cross-linked EVA having 50% to 60% proportion of vinyl acetate. The unitary body holster 100 is configured so that the internal shoulder 140 applies a force 160 on the firearm 200 to push the firearm 200 into engagement with the first end 120 of the inner cavity 110 upon insertion of the firearm 200 into the inner cavity 110. The internal shoulder 140 may apply a force on the trigger guard 230 of the firearm 200 so that a rear end of the slide 220 and the frame 250 engages a feature(s) on the first end 120 of the inner cavity 110 of the unitary body holster 100.

Figure 4:
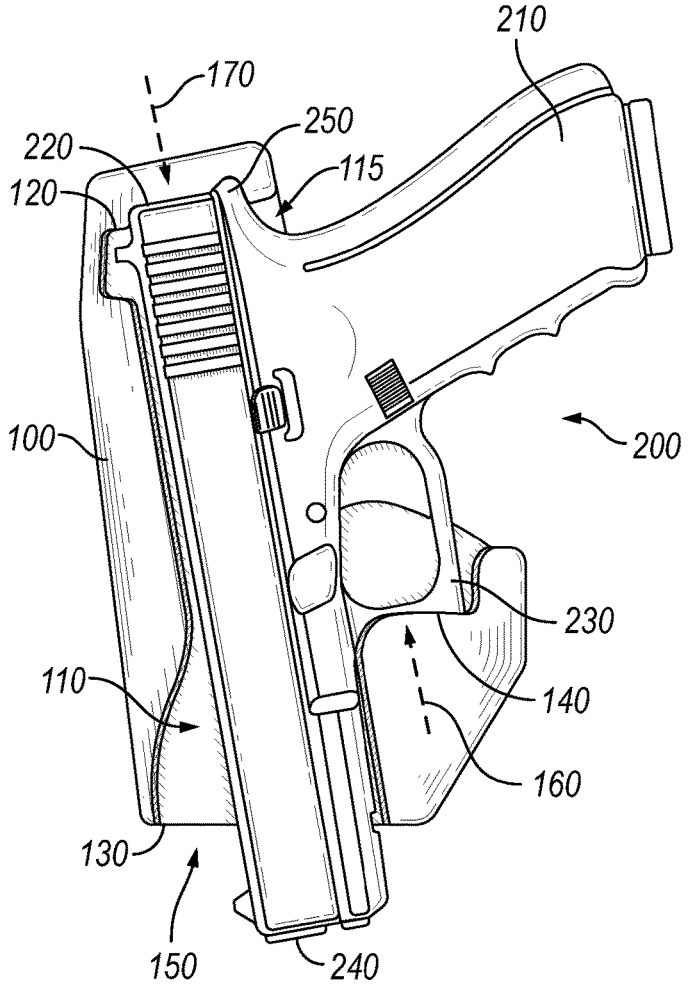
FIGS. 4-8 are cross-section schematics showing a firearm being removed from an embodiment of a holster.
Figure 5:
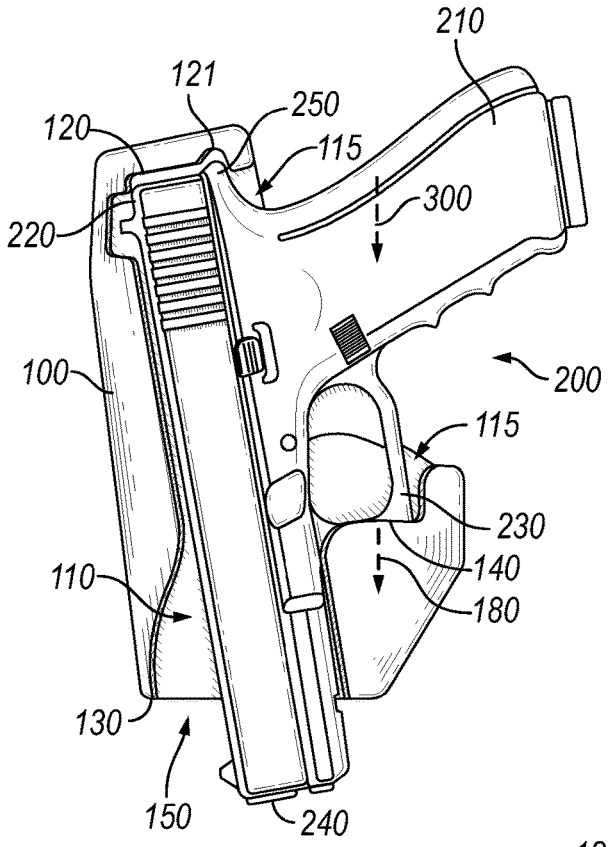

FIGS. 4-8 are cross-section schematics showing a firearm 200 being removed from an embodiment of a unitary body holster 100. FIG. 4 shows a firearm 200 selectively retained within the unitary body holster 100. The internal shoulder 140 within the inner cavity 110 applies a force 160 against the trigger guard 230 of the firearm 200. The force 160 pushes the firearm 200 against the first end 120 of the inner cavity 110. As the unitary body holster 100 is comprised of a compressible material, such as EVA, the first end 120 of the inner cavity 110 applies a force (i.e., pushes) 170 back against the slide 220 of the firearm. The first end 120 is configured to engage a feature of the firearm 200 to selectively retain the firearm 200 within the inner cavity 110. For example, the first, or upper, end, 120 may include a recess 121 configured to receive the frame 250 as shown in FIG. 5.

The internal shoulder 140 and first end 120 engage the firearm 200 and prevent the firearm 200 from being removed from the unitary body holster 100 by simply pulling on the firearm 200. Instead, the firearm 200 must first be pushed downward and then pivoted away from the unitary body holster 100 while still being pushed downward to remove the firearm 200 as discussed herein. FIG. 5 shows a force 300 applied to the firearm 200 to move the firearm 200 downward within the inner cavity 110 of the unitary body holster 100. The downward movement caused by the force 300 causes the internal shoulder 140 to compress as indicated by arrows 180. The downward movement of the firearm 200 also causes the first, or upper, end 120 of the inner cavity 110 to disengage from the firearm 200.

Figure 6:
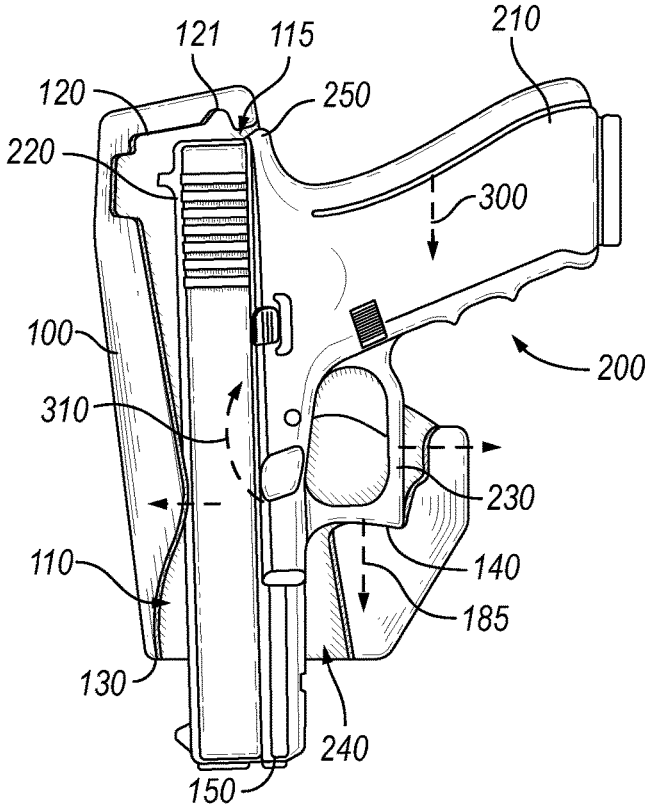
Figure 7:
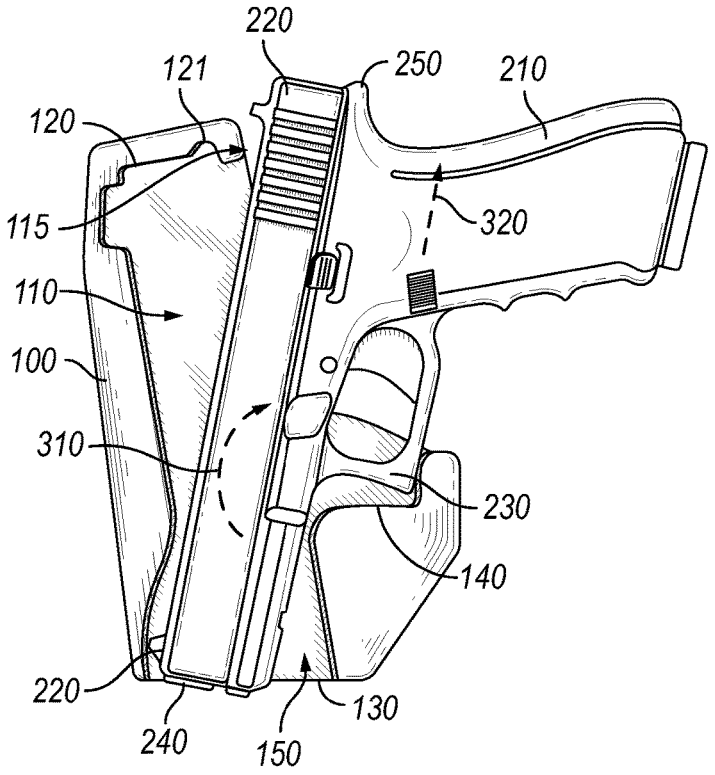
Figure 8:
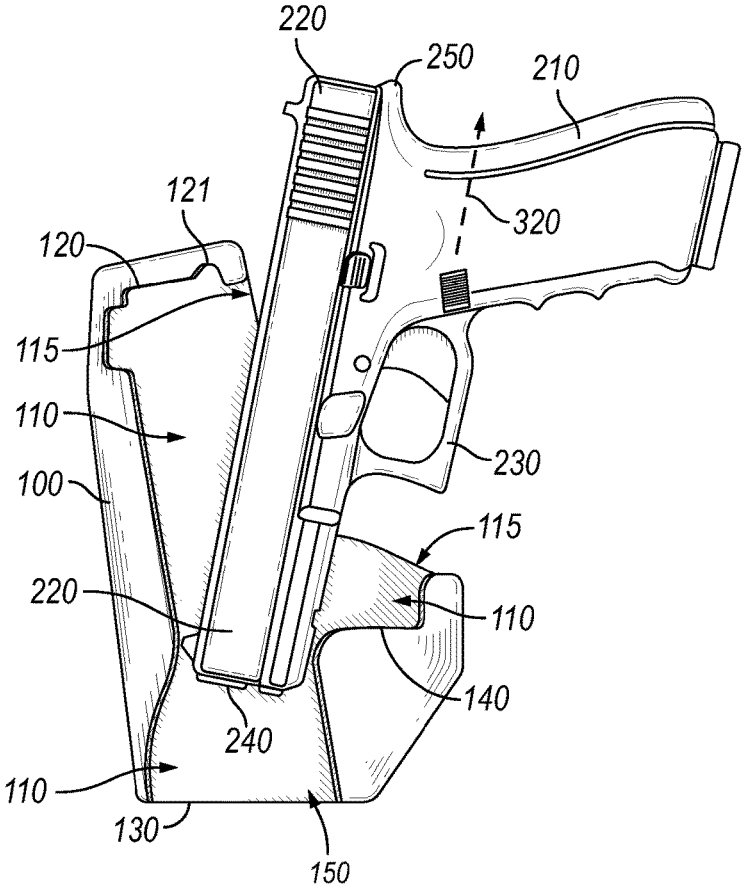

FIG. 6 shows the firearm 200 being pivoted, or rotated, as indicated by arrow 310 while the force 300 is still applied to the firearm 200. The rotation and downward movement cause the internal shoulder 140 to further compress as indicated by arrows 185. The rotation, or pivoting, of the firearm 200 causes the rear end of the firearm 200 to clear the first end 120 of the inner cavity 110 and the front end of the firearm 200 to move laterally within second opening 150. Once the rear end of the firearm 200 is clear of the first end 120 of the inner cavity 110, an upward force, as indicated by arrow 320, as well as continued rotation, indicated by arrow 310, may be applied to the firearm 200 to begin removing the firearm 200 from the unitary body holster 100 as shown in FIG. 7. Finally, an upward force 320 may be applied to remove the firearm 200 from the unitary body holster 100.

The configuration of the unitary body holster 100 as shown in FIG. 1-8 is shown for illustrative purposes and may be varied as would be appreciated by one of ordinary skill in the art having the benefit of this disclosure. The shape and configuration of the unitary body holster 100 may be varied to selectively retain various makes and/or models of firearms. The shape and/or position of the inner cavity 110, first opening 115, upper end 120, lower end 130, internal shoulder 140, and second opening 150 may each be adapted to collectively selectively retain various firearms inserted into the unitary body holster 100 as would be appreciated by one of ordinary skill in the art having the benefit of this disclosure.

As discussed herein, a firearm may be holstered (i.e., secured) in the holster of the present disclosure. To secure a firearm, the barrel and slide may be slid into the holster forward at an approximately 45-degree angle. As the barrel and slide enter the holster, the trigger guard engages an internal shoulder. The firearm is inserted into the holster with continued downward pressure while rotating the firearm forward until it contacts and compresses against the front wall of the holster bringing the firearm to a vertical position. Reducing the downward pressure allows rebound (i.e., force) from the internal shoulder to force the rear aspect of the slide and frame into engagement with the upper end of the holster. The upward pressure caused by the rebound of the internal shoulder together with the downward pressure created from the upper end of the holster establishes a constant vertical tension on the firearm.

The same dynamic used to generate constant vertical tension is employed to create horizontal tension. The holster rebounds toward the inward side of the holster. The inside wall of the internal shoulder, which is compressed during rotation of the firearm, rebounds in the opposite direction creating constant horizontal tension. The firearm is secured within the holster by the forces applied from the portions of the holster onto the firearm.

The holster design is intuitive for the operator and counter intuitive to one attempting to gain unauthorized access to the firearm. The firearm may be removed from the holster by pushing straight downward on the grip until the slide/frame disengages from the upper end of the holster. Afterwards, the firearm is rotated to the rear and slid out at an approximately a 45-degree angle. Attempting to remove the weapon by pulling up, back, or to the side will not be successful. Pushing down and rotating is counter intuitive to one trying to snatch or commandeer the firearm. Additionally, pushing straight down and then properly rotating is difficult, if not impossible, unless you are wearing the holster. The weapon ever being dislodged or dropped from this holster of the present disclosure is highly unlikely.

Figure 9:
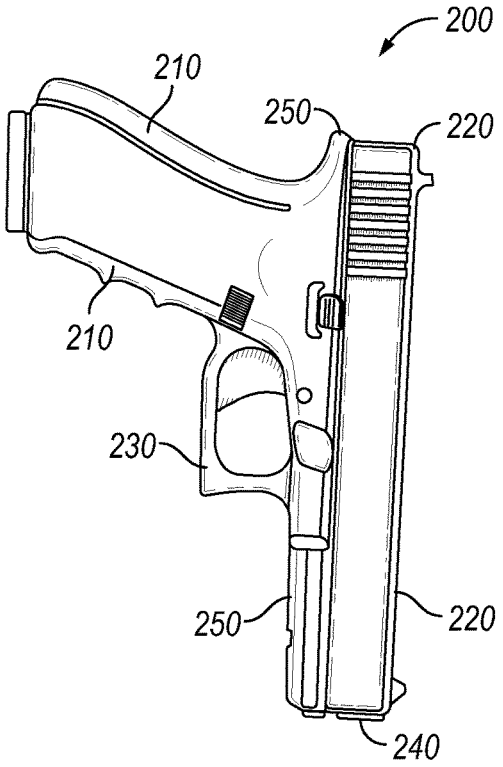
FIG. 9 is a side view of a firearm.
Figure 10:
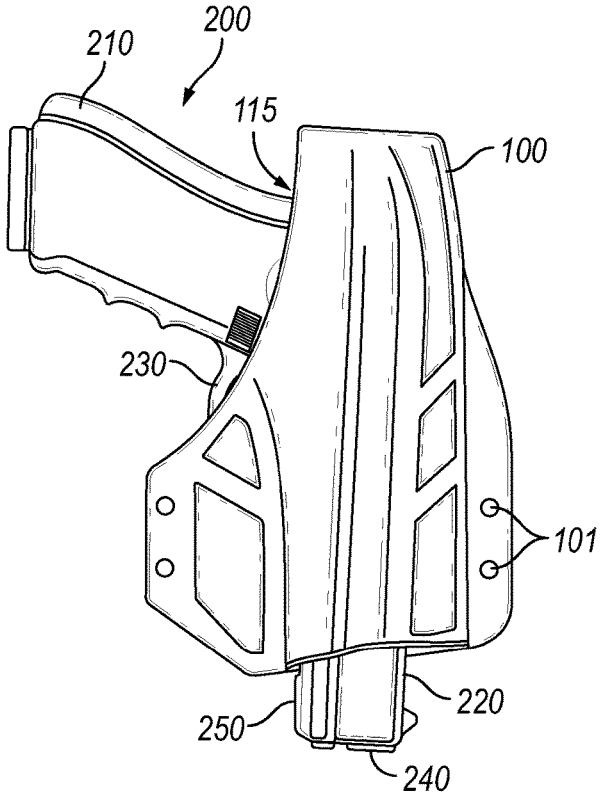
FIG. 10 is a is a side view of a firearm retained within an embodiment of a holster.
Figure 11:
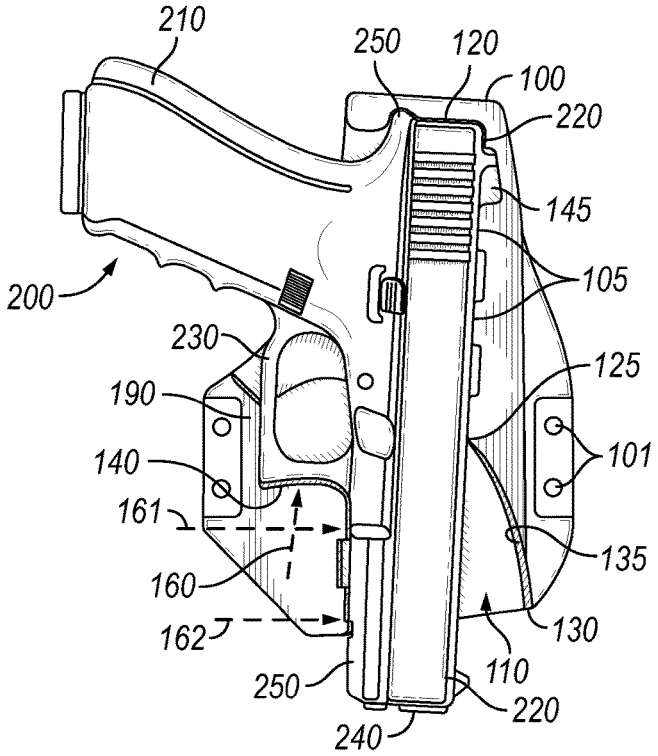
FIG. 11 is a cross-section schematic showing a firearm retained within an embodiment of a holster.

FIG. 9 is a side view of a firearm 200. The firearm 200 includes a grip 210, a slide 220, a trigger guard 230, a barrel 240, and a frame 250. FIG. 10 is a side view of the firearm 200 selectively retained within an embodiment of a unitary body holster 100. The unitary body holster 100 selectively self-retains the firearm 200 within the unitary body holster 100 as discussed herein. FIG. 11 is a cross-section schematic showing a firearm 200 selectively retained within a unitary body holster 100. As shown a portion of the grip 210 of the firearm 200 protrudes from one end of the unitary body holster 100 and a portion of the slide 220 and the frame 250 of the firearm 200 protrudes from the other end of the unitary body holster 100.

The holster 100 is formed of a unitary body and includes an inner cavity 110. The holster 100 includes one or more apertures 101 that enable the holster 100 to be attached to another component, such as but not limited to a belt. Other mechanisms may be used to attach the holster 100 to another component as would be appreciated by one of ordinary skill in the art having the benefit of this disclosure. The inner cavity 110 includes a slide cap 120 (also referred to as a first or upper end) and a second, or lower, end 130. The unitary body holster 100 includes a first opening 115 that is generally adjacent to the slide cap 120 of the holster 100. The first opening 115 is configured to enable a firearm 200 to be inserted into the inner cavity 110 of the unitary body holster 100. The unitary body holster 100 includes a second opening 150 adjacent to the second end 130 of the holster 100. The unitary body holster 100 includes an internal shoulder 140. The unitary body holster 100 does not include any separate components. The unitary body holster 100 also does not include any moving components.

The slide cap 120 of the holster 100 applies a force 170 to the slide 220 and a force 171 to the frame 250 of the firearm 200 when a firearm 200 is secured within the holster 100 as discussed herein. The holster 100 includes one or more compression pads 105 located in adjacent to the inner cavity 110. The compression pads 105 may be separated by gaps 106. The one or more compression pads 105 are configured to apply a force 192 against the slide 220 of a firearm 200 when a firearm 200 is secured within the holster 100. The holster includes a fulcrum cushion 125 located adjacent to the inner cavity 110. A firearm 200 is pivoted and rotated against the fulcrum cushion 125 as the firearm 200 is removed from the holster 100 as discussed herein. The fulcrum cushion 125 is configured to apply a force 193 against the slide 220 of the firearm 200 as discussed herein. The holster 100 includes an internal shoulder 140 adjacent to the inner cavity 110. The internal shoulder 140 applies a force 160 against the trigger guard 230 of the firearm 200 when a firearm 200 is secured within the holster 100 as discussed herein. The holster 100 includes a trigger guard wall 190 that is positioned adjacent to the inner cavity 110 of the holster 100. The trigger guard wall 190 applies a force 191 against the trigger guard 230 of the firearm 200 when a firearm 200 is secured within the holster 100.

The holster 100 includes a radial relief 135 adjacent the inner cavity 110 that enables the firearm 200 to be pivoted and removed from the holster 100 as discussed herein. The holster 100 includes frame pads 141 and 142 positioned adjacent to the inner cavity 110. The frame pads 141 and 142 apply forces 161 and 162 to the frame 250 of the firearm 200 when a firearm 200 is secured within the holster as discussed herein.

The unitary body holster 100 is comprised of a compressible material. As used herein, a compressible material is an elastically deformable material. The compressible material may be an elastomer. For example, the elastomer may be EVA, rubber, silicon, or the like, or a combination thereof. In a preferred embodiment, the elastomer may be a cross-linked EVA having 50% to 60% proportion of vinal acetate. The unitary body holster 100 is configured so that the internal shoulder 140, frame pads 141 and 142, the compression pads 105, the fulcrum cushion 125, slide cap 120, and the trigger guard wall 190 each applies a force on the firearm 200 to selectively retain a firearm 200 within the holster 100 as discussed herein.

Figure 12:
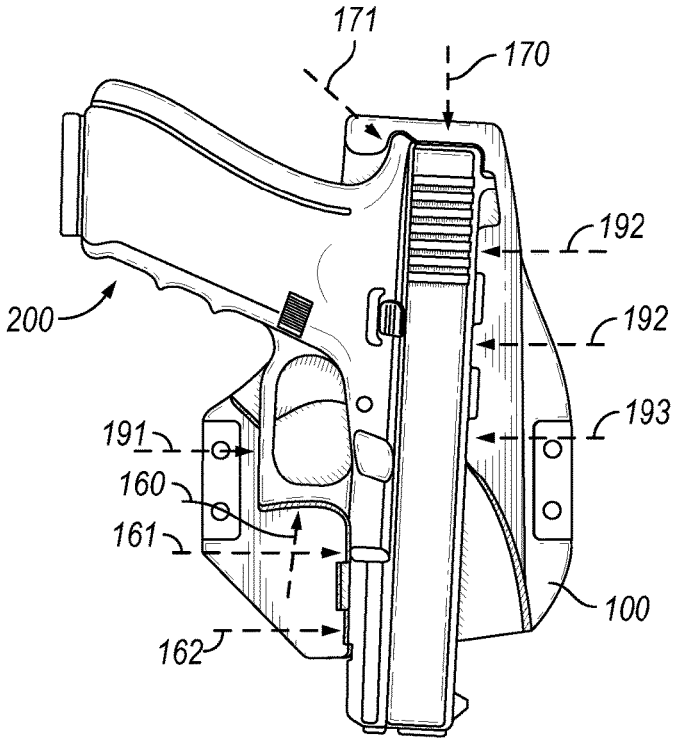
FIGS. 12-16 are cross-section schematics showing a firearm being removed from an embodiment of a holster.

FIGS. 12-16 are cross-section schematics showing a firearm 200 being removed from an embodiment of a unitary body holster 100. FIG. 12 shows a firearm 200 selectively retained within the unitary body holster 100. The internal shoulder 140 within the inner cavity 110 applies a force 160 against the trigger guard 230 of the firearm 200. The force 160 pushes the firearm 200 against the slide cap 120 of the inner cavity 110. As the unitary body holster 100 is comprised of a compressible material, such as EVA, the slide cap 120 likewise applies a force 170 against the slide 220 of the firearm 200 and applies a force 171 against the frame 250 of the firearm 200. The slide cap 120 is configured to engage a feature of the firearm 200 to selectively retain the firearm 200 within the inner cavity 110. For example, the slide cap 120 may include a recess 121 configured to receive the frame 250. The holster 100 may include a recess 122 adjacent to the inner cavity 110 that is configured for the insertion of a rear sight of the firearm 200 when a firearm 200 is secured within the holster 100. The compression pads 105 applies a force 192 against the slide 220 of the firearm 200. Likewise, the fulcrum cushion 125 applies a force 193 against the slide 220 of the firearm 200. As the unitary body holster 100 is comprised of a compressible material, such as EVA, the trigger guard 230 applies a force 191 in the opposite direction of the forces 192, 193 applied by the compression pads 105 and the fulcrum cushion 125. Likewise, the frame pads 141 and 142 apply forces 161 and 162 in a direction opposite the forces applied by the compression pads 105 and the fulcrum cushion 125.

Figure 13:
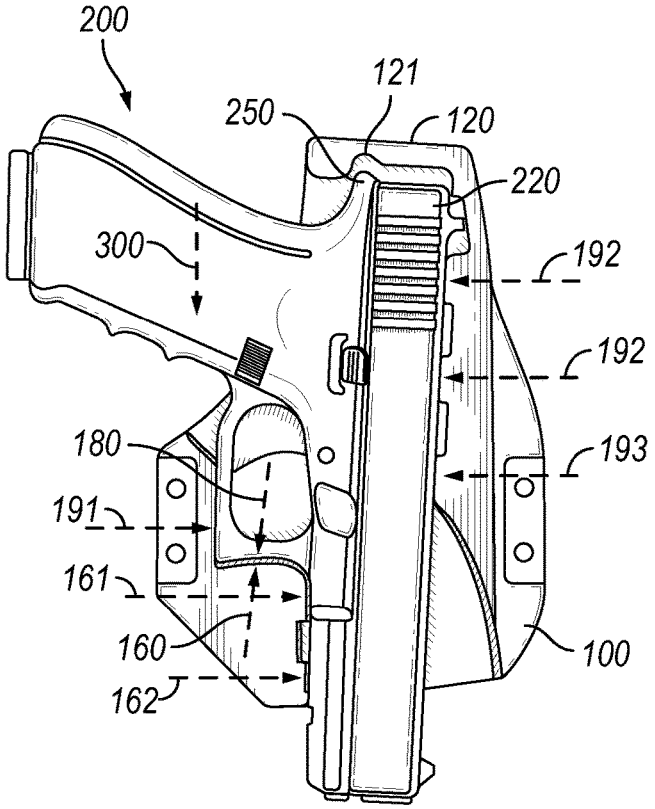

The various components of the holster 100 engage the firearm 200 and prevent the firearm 200 from being removed from the unitary body holster 100 by simply pulling on the firearm 200. Instead, the firearm 200 must first be pushed downward 300 and then pivoted away from the unitary body holster 100 while being pushed downward to remove the firearm 200 as discussed herein. FIG. 13 shows a force 300 applied to the firearm 200 to move the firearm 200 downward within the inner cavity 110 of the unitary body holster 100. The downward movement caused by the force 300 causes the internal shoulder 140 to compress as indicated by arrow 180. The downward movement of the firearm 200 also causes the slide cap 120 to disengage from the firearm 200. As shown in FIG. 13, the frame 250 and slide 220 of the firearm 200 are moved away from the holster 100 and the slide cap 120 no longer applies a force to the firearm 200.

Figure 14:
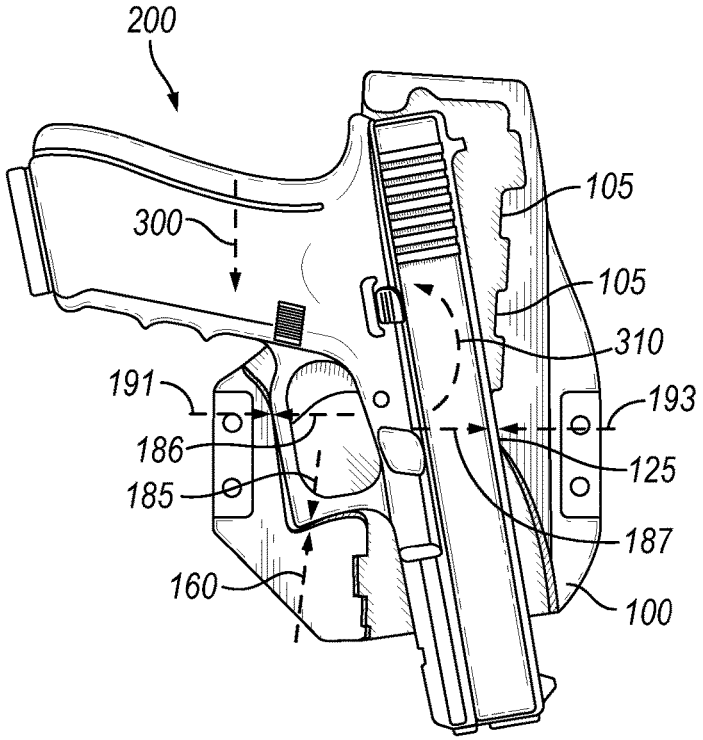
Figure 15:
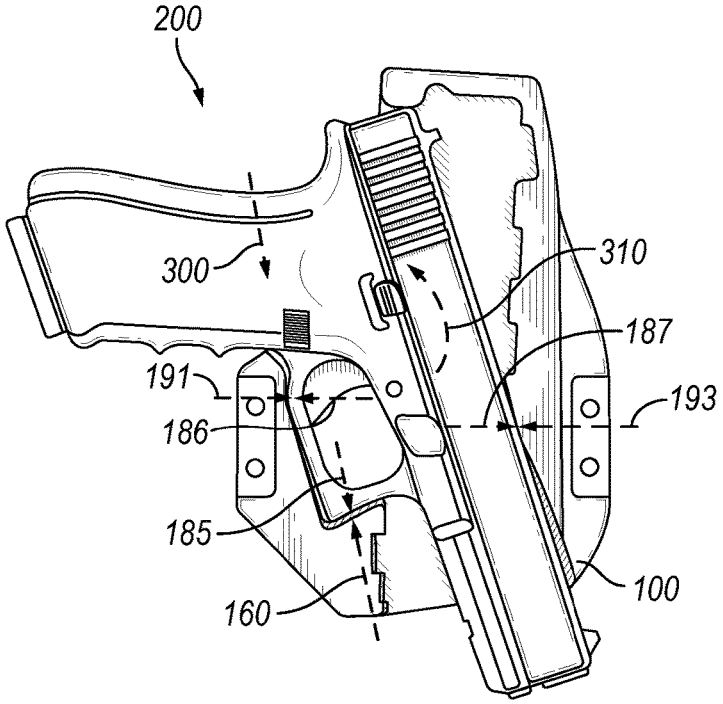
Figure 16:
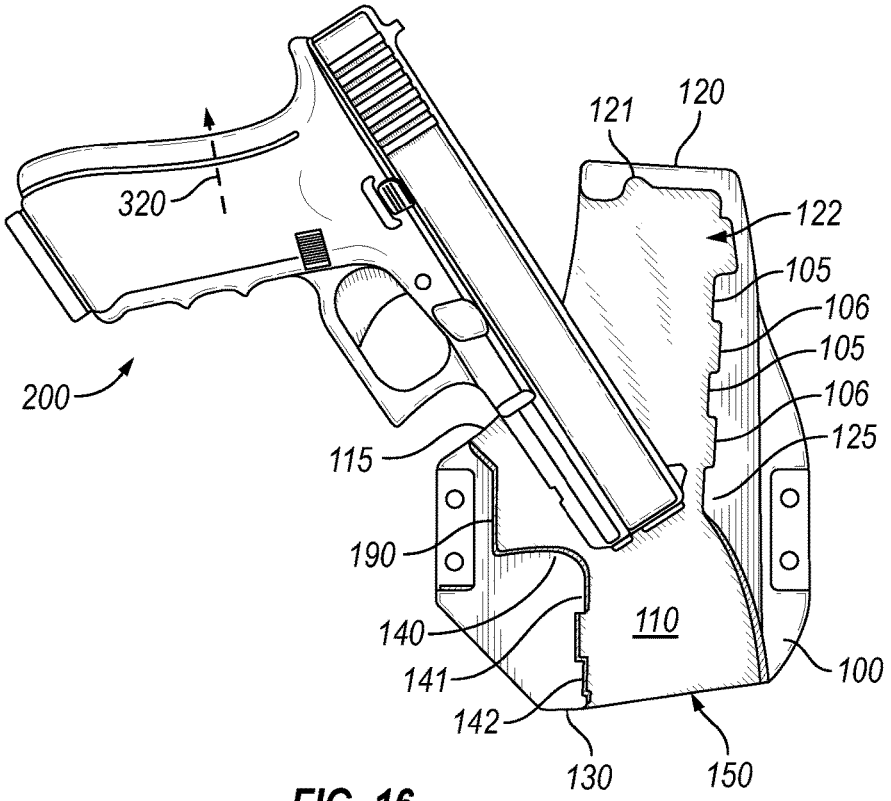

FIG. 14 shows the firearm 200 being pivoted, or rotated, as indicated by arrow 310 while the force 300 is still applied to the firearm 200. The rotation and downward movement cause the internal shoulder 140 to further compress as indicated by arrows 185. The rotation, or pivoting, of the firearm 200 causes the slide 220 of the firearm 200 to moved away from the compression pads 105, which no longer apply a force to the firearm 200. The firearm 200 is pivoted about the fulcrum cushion 125, which continues to apply a force 193 to the slide 220 of the firearm 200. The rotation, or pivoting, of the firearm 200 applies a force 187 in the opposite direction than the force 193 applied by the fulcrum cushion 125 to the slide 220. The rotation, or pivoting, of the firearm 200 causes the trigger guard 230 of the firearm 200 to apply a force 186 to the trigger guard wall 190 of the holster 100 in the opposite direction of the force 191 applied to the firearm 200 by the trigger guard wall 190 of the holster 100. The continued rotation, or pivoting, of the firearm 200 causes the rear end of the firearm 200 to clear the slide cap 120 of the holster as shown in FIG. 15. Once clear, an upward force 320 may be used remove the firearm 200 from the unitary body holster 100 as shown in FIG. 16.

The configuration of the unitary body holster 100 as shown in FIGS. 9-16 is shown for illustrative purposes and may be varied as would be appreciated by one of ordinary skill in the art having the benefit of this disclosure. The shape and configuration of the unitary body holster 100 may be varied to selectively retain various makes and/or models of firearms. The shape and/or position of the compression pads 105, gaps 106 between compression pads, inner cavity 110, first opening 115, slide cap 120, recess 121, fulcrum cushion 125, lower end 130, radial relief 135, internal shoulder 140, frame pads 141, 142, second opening 150, and trigger guard wall 190 may each be adapted to collectively selectively retain various firearms inserted into the holster 100 as would be appreciated by one of ordinary skill in the art having the benefit of this disclosure.

The holster 100 is at rest when a firearm 200 is not located within the holster 100. In other words, the surfaces of the holster 100 do not apply any forces and the material is at rest as shown by the lack of arrows in FIG. 16 showing the firearm 200 removed from the holster 100. Upon insertion of a firearm 200 into the holster 100, the holster 100 becomes loaded and statically holds the firearm 200 within the holster 100 by numerous internal surfaces of the holster 100 apply forces against the firearm 200 as discussed herein. The firearm 200 is retained securely within the holster 100 so that there is no rattle as a user wearing the holster 100 moves about. As shown in FIG. 12, the holster 100 is configured to apply a number of forces 160, 161, 162, 170, 171, 191, 192, 193 against the firearm 200 to securely retain the firearm 200 within the holster 100. The surfaces of the inner cavity 110 of the holster 100 are configured so that the insertion of a firearm 200 into the holster 100 causes the surfaces of the holster 100 to statically retain the firearm 200 once fully inserted until a user presses downward, rotates, and pulls the firearm 200 out of the inner cavity 110 of the holster 100.

Figure 17:
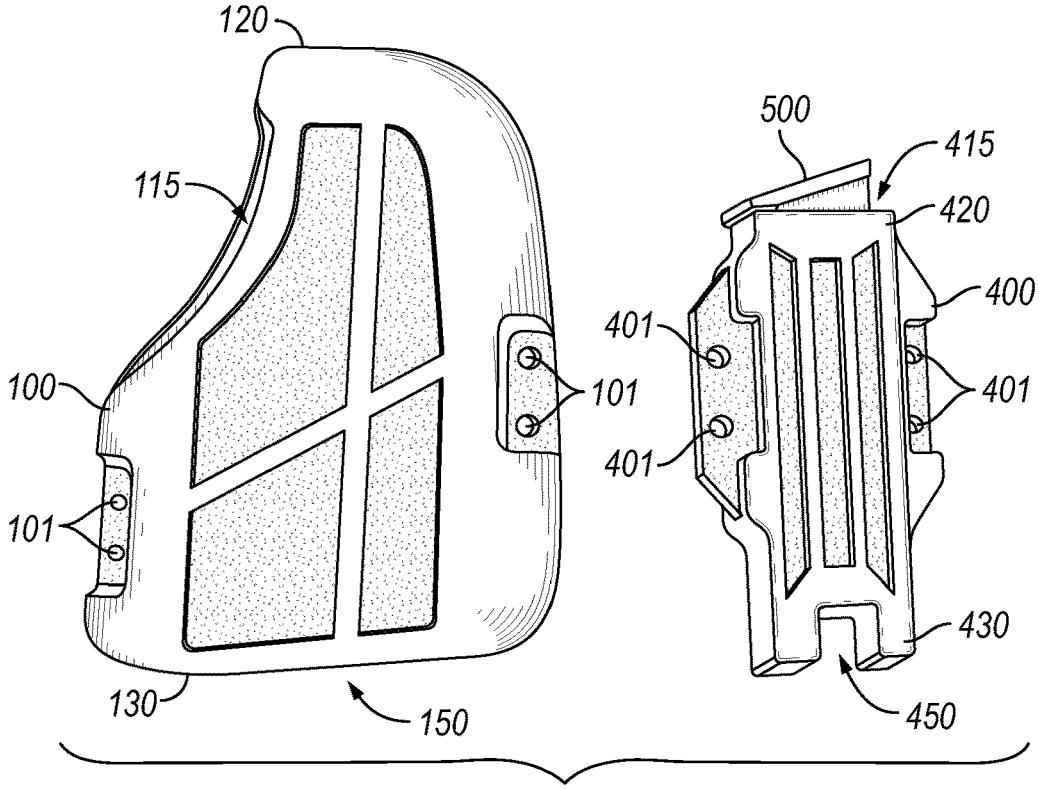
FIG. 17 shows an embodiment of a firearm holster and an embodiment of a magazine holster with a magazine secured within the magazine holster.

FIG. 17 shows an embodiment of a firearm holster 100 and an embodiment of a magazine holster 400 with a magazine 500 secured within the magazine holster 400. The magazine holster 400 may be formed of a unitary body and includes an inner cavity 410 (shown in FIG. 19). The magazine holster 400 includes one or more apertures 401 that enable the magazine holster 400 to be attached to another component, such as but not limited to a belt. The inner cavity 410 includes a first, or upper, end 420 and a second, or lower, end 430. The magazine holster 400 includes a first opening 415 that is generally adjacent to the first end 420 of the inner cavity 410. The first opening 415 is configured to enable a magazine 500 to be inserted into the inner cavity 410 of the magazine holster 400. The magazine holster 400 may include a second opening 450 adjacent to the second end 430 of the inner cavity 410. When a magazine 500 is inserted into the magazine holster 400, an end of the magazine 500 may be visible through the second opening 450. The magazine holster 400 include one or more internal shoulders 425 (shown in FIG. 19). The magazine holster 400 does not include any separate components and does not include any moving components.

The magazine holster 400 is comprised of a compressible material. As used herein, a compressible material is an elastically deformable material. The compressible material may be an elastomer. For example, the elastomer may EVA, rubber, silicon, or the like, or a combination thereof. In an embodiment, the elastomer may be a cross-linked EVA having 50% to 60% proportion of vinal acetate. The magazine holster 400 is configured so that the internal shoulders 425 applies a force onto a magazine 500 inserted to the magazine holster 400 to selectively retain the magazine 500 within the magazine holster 400. A user will have to apply a force to the magazine 500 to push against the internal shoulders 425 to remove the magazine 500 from the magazine holster 400.

FIG. 17 also shows a unitary body holster 100 selectively self-retains a firearm 200 within the unitary body holster 100 as discussed herein. The holster 100 is formed of a unitary body and includes an inner cavity 110 (not shown). The holster 100 includes one or more apertures 101 that enable the holster 100 to be attached to another component, such as but not limited to a belt. The inner cavity 110 includes a first, or upper, end 120 and a second, or lower, end 130. The unitary body holster 100 includes a first opening 115 that is generally adjacent to the first end 120 of the inner cavity 110. The first opening 115 is configured to enable a firearm 200 to be inserted into the inner cavity 110 of the unitary body holster 100, starting with the barrel 240. The unitary body holster 100 may include a second opening 150 adjacent to the second end 130 of the inner cavity 110. When the firearm 200 is inserted into the unitary body holster 100, the end of the frame 250 and slide 220 may extend through the second opening 150. The second opening 150 may have a width greater than a width of the end of the frame 250 and slide 220 extending therethrough. The unitary body holster 100 includes an internal shoulder 140. The unitary body holster 100 does not include any separate components. The unitary body holster 100 also does not include any moving components.

As discussed herein, the unitary body holster 100 is comprised of a compressible material. As used herein, a compressible material is an elastically deformable material. The compressible material may be an elastomer. For example, the elastomer may be EVA, rubber, silicon, or the like, or a combination thereof. In an embodiment the elastomer may be a cross-linked EVA having 50% to 60% proportion of vinal acetate.

The unitary body holster 100 is configured so that the internal shoulder applies a force 160 on the firearm 200 to push the firearm 200 into engagement with the first end 120 of the inner cavity 110 upon insertion of the firearm 200 into the inner cavity 110. The internal shoulder may apply a force on the trigger guard 230 of the firearm 200 so that a rear end of the slide 220 and the frame 250 engages a feature(s) on the first end 120 of the inner cavity HO of the unitary body holster 100.

Figure 18:
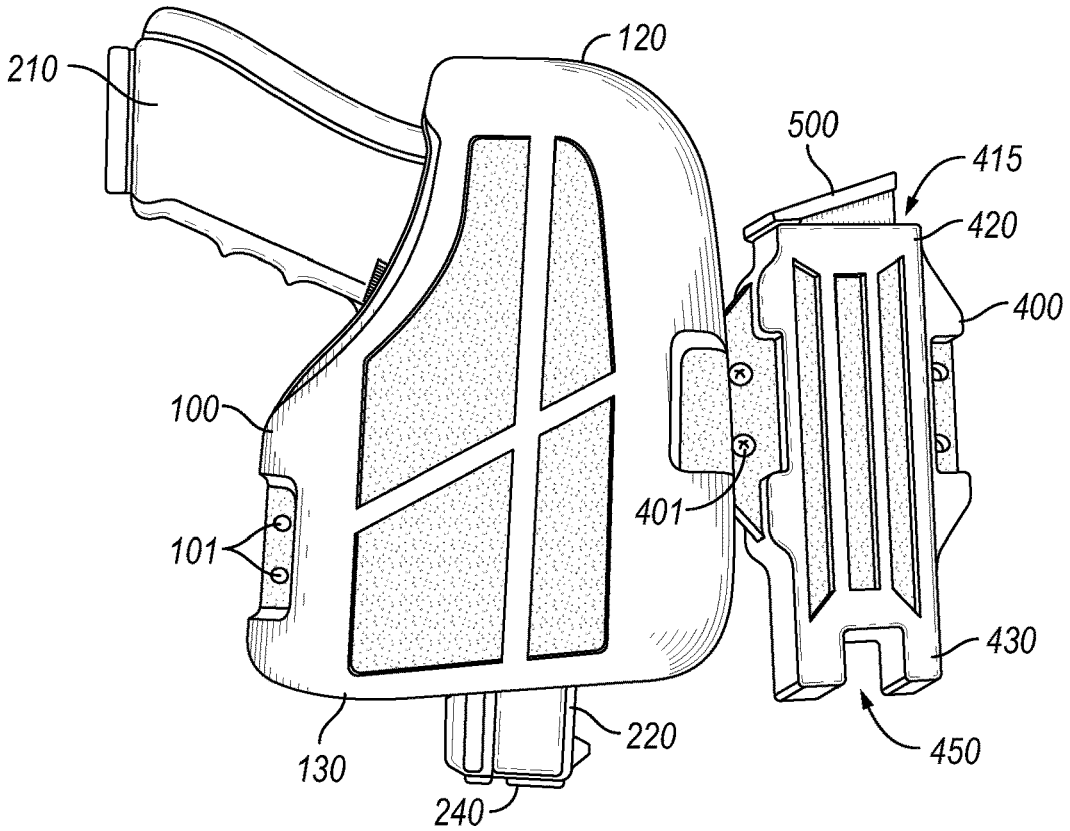
FIG. 18 shows an embodiment of a firearm holster with a firearm secured within the firearm holster and an embodiment of a magazine holster with a magazine secured within the magazine holster.
Figure 19:
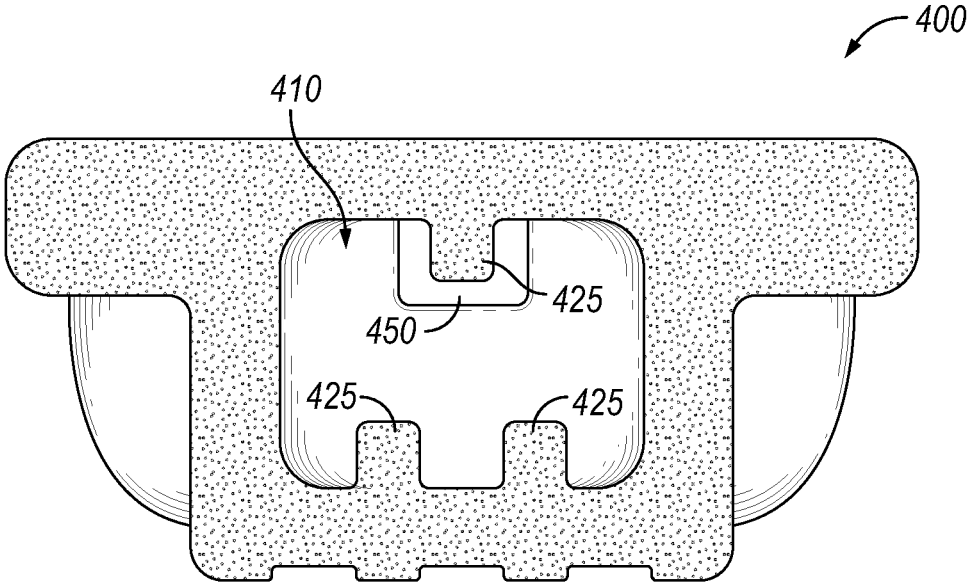
FIG. 19 shows a cross-section view of an embodiment of a magazine holster.

FIG. 18 shows a firearm 200 secured within the firearm holster 100. Likewise, FIG. 18 shows a magazine 500 secured within the magazine holster 400. FIG. 19 is a cross-section view of an embodiment of a magazine holster 400. The magazine holster 400 includes an inner cavity 410 that is configured to receive a magazine 500. The magazine holster 400 includes one or more internal shoulders 425 that apply a force against a magazine 500 inserted into the inner cavity 410 to selectively retain the magazine 500 within the magazine holster 400. The magazine holster 400 may include a second opening 450 as shown in FIG. 19.

Figure 20:
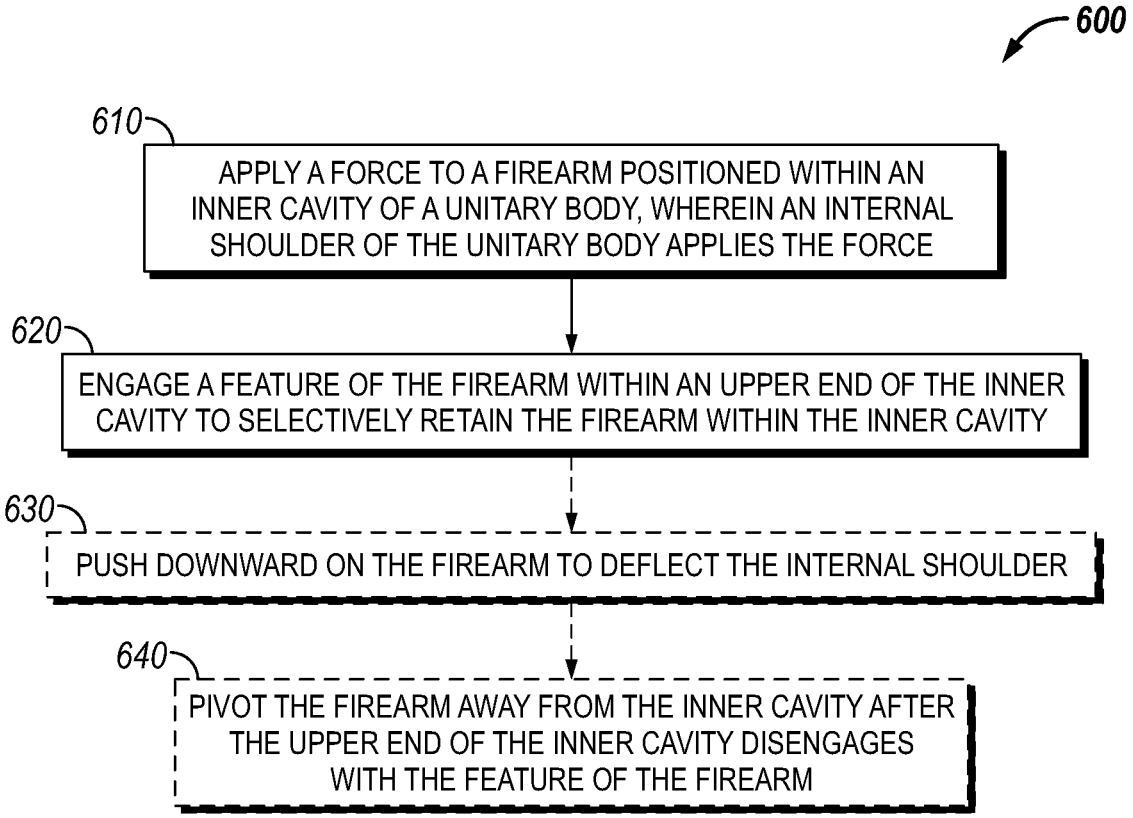
FIG. 20 is a flow chart of an embodiment of a method of the present disclosure.

FIG. 20 is a flowchart of a method 600 of the present disclosure. The method 600 includes applying a force to a firearm positioned within an inner cavity of a unitary body, wherein an internal shoulder of the unitary body applies the force, at 610. The method 600 includes engaging a feature of the firearm with an upper end of the inner cavity to selectively retain the firearm within the inner cavity, at 620. The method 600 may include pushing downward on the firearm to deflect the internal shoulder, at 630. The method 600 may include pivoting the firearm away from the inner cavity after the upper end of the inner cavity disengages with the feature of the firearm, at 640.

Figure 21:
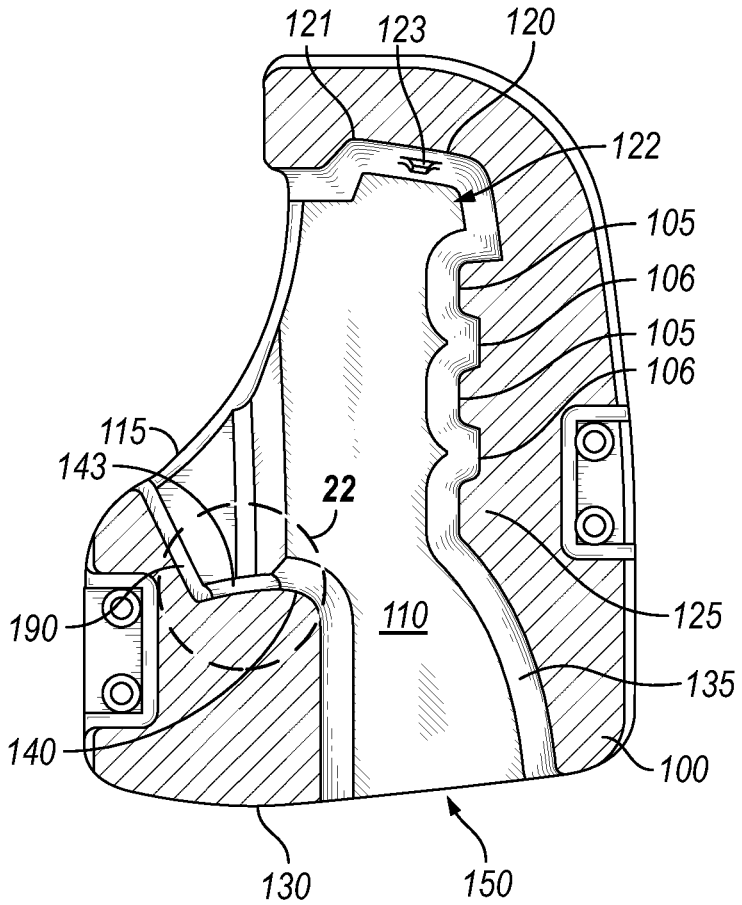
FIG. 21 shows a cross-section view of an embodiment of a firearm holster.
Figure 22:
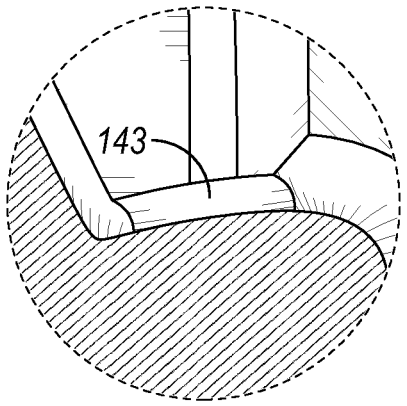
FIG. 22 is a close-up cross-section view of a portion of the firearm holster of FIG. 22.

FIG. 21 is a cross-sectional view of an embodiment of a firearm holster 100. The holster 100 is formed of a unitary body and includes an inner cavity 110. The holster 100 includes one or more apertures 101 that enable the holster 100 to be attached to another component, such as but not limited to a belt. The inner cavity 110 includes a slide cap 120 (also referred to as a first or upper end) and a second, or lower, end 130. The unitary body holster 100 includes a first opening 115 that is generally adjacent to the slide cap 120 of the holster 100. The first opening 115 is configured to enable a firearm (not shown) to be inserted into the inner cavity 110 of the unitary body holster 100. The unitary body holster 100 includes a second opening 150 adjacent to the second end 130 of the holster 100. The unitary body holster 100 includes an internal shoulder 140. The unitary body holster 100 does not include any separate components. The unitary body holster 100 also does not include any moving components.

The slide cap 120 of the holster 100 applies a force to the slide of a firearm and a force to the frame of the firearm when a firearm is secured within the holster 100. The holster 100 includes one or more compression pads 105 located in adjacent to the inner cavity 110. The compression pads 105 may be separated by gaps 106. The one or more compression pads 105 are configured to apply a force against the slide of a firearm when a firearm is secured within the holster 100. The holster includes a fulcrum cushion 125 located adjacent to the inner cavity 110. A firearm 200 is pivoted and rotated against the fulcrum cushion 125 as the firearm 200 is removed from the holster 100 as discussed herein. The fulcrum cushion 125 is configured to apply a force against the slide of the firearm as discussed herein. The holster 100 includes an internal shoulder 140 adjacent to the inner cavity 110. The internal shoulder 140 includes a first projection 143 that extends away from the internal shoulder 140. The internal shoulder 140 applies a force via the projection 143 against the trigger guard of the firearm when a firearm is secured within the holster 100 as discussed herein. The holster 100 includes a trigger guard wall 190 that is positioned adjacent to the inner cavity 110 of the holster 100. The trigger guard wall 190 applies a force against the trigger guard of the firearm when a firearm is secured within the holster 100. The slide cap 120 includes a second projection 123 that extends away from the slide cap 120.

The holster 100 includes a radial relief 135 adjacent the inner cavity 110 that enables the firearm to be pivoted and removed from the holster 100 as discussed herein. The unitary body holster 100 is comprised of a compressible material. As used herein, a compressible material is an elastically deformable material. The compressible material may be an elastomer. For example, the elastomer may be EVA, rubber, silicon, or the like, or a combination thereof. In a preferred embodiment, the elastomer may be a cross-linked EVA having 50% to 60% proportion of vinal acetate. The unitary body holster 100 is configured so that the internal shoulder 140 and first projection 143, the compression pads 105, the fulcrum cushion 125, the slide cap 120 and the second projection 123, and the trigger guard wall 190 each applies a force on the firearm 200 to selectively retain a firearm 200 within the holster 100 as discussed herein. The first projection 143 on the inner shoulder 140 is depressed within the inner cavity 110 as a firearm is inserted into the holster 100. The addition of the first projection 143 may aid the removal of a firearm from the holster 100 as the firearm is pressed downward and rotated out of the holster 100 due to the fact that the first projection 143 is not connected to the sidewalk of the holster 100. Instead, the first projection 143 is only connected directly to the surface of the inner surface 140. The addition of the second projection 123 may also aid in the removal of a firearm from the holster 100 as the second projection 123 is only connected directly to the surface of the slide cap 120 and the walls of the holster 100.

Although this disclosure has been described in terms of certain examples, other examples that are apparent to those of ordinary skill in the art, including examples that do not provide all of the features and advantages set forth herein, are also within the scope of this disclosure. Accordingly, the scope of the present disclosure is defined only by reference to the appended claims and equivalents thereof

What is claimed is:

1. A firearm holster comprising:

a unitary body having an inner cavity configured to receive a firearm and a slide cap that partially encloses the inner cavity, the inner cavity having a first end and a second end opposite of the first end with the slide cap being adjacent the first end;

a first opening into the inner cavity adjacent to the first end of the unitary body;

a second opening into the inner cavity adjacent to the second end of the unitary body an internal shoulder positioned within the inner cavity; and the unitary body selectively retains a firearm positioned within the inner cavity, wherein a force is applied to the firearm by the internal shoulder to push the firearm against the slide cap to selectively retain the firearm and wherein there are no moving components.

2. The firearm holster of claim 1, further comprising a first projection that extends from the internal shoulder.

3. The firearm holster of claim 2, further comprising a second projection that extends from the first end of the inner cavity.

4. The firearm holster of claim 1, wherein the first end of the cavity is configured to engage a portion of a firearm.

5. The firearm holster of claim 4, wherein the first end of the cavity is configured to engage a portion of a slide of the firearm.

6. The firearm holster of claim 1, wherein the first opening is configured to enable a firearm to be inserted into the inner cavity.

7. The firearm holster of claim 6, wherein the second opening is configured so a portion of a barrel of a firearm and a portion of the slide both extend through the second opening.

8. The firearm holster of claim 1, wherein the unitary body comprises a compressible material.

9. The firearm holster of claim 8, wherein the unitary body is an elastomer, a thermoplastic elastomer, ethylene vinyl acetate, rubber, silicon, or a combination thereof.

10. The firearm holster of claim 1, wherein the internal shoulder applies the force to a trigger guard of the firearm.

11. The firearm holster of claim 1, wherein a firearm may be selectively removed from the inner cavity by an application of a force on the firearm toward the internal shoulder and by a rotation of the firearm away from the holster while the force is being applied.

12. The firearm holster of claim 1, wherein the holster is comprised of ethylene vinyl acetate (EVA).

13. The firearm holster of claim 12, wherein the EVA is cross-linked EVA and has 50% to 60% proportion of vinal acetate.

14. A method of selectively retaining a firearm, the method comprising:

applying a force to a firearm positioned within an inner cavity of a unitary body, wherein an internal shoulder of the unitary body applies the force;

engaging a feature of the firearm with an upper end of the inner cavity to selectively retain the firearm within the inner cavity;

pushing downward on the firearm to deflect the internal shoulder; and pivoting the firearm away from the inner cavity after the upper end of the inner cavity disengages with the feature of the firearm.

15. The method of claim 14 wherein the firearm is selectively retained within the inner cavity with no moving components.

16. A firearm holster comprising:

a unitary body having an inner cavity configured to receive a firearm, the inner cavity having a first end and a second end opposite of the first end;

a first opening into the inner cavity adjacent to the first end of the unitary body;

a second opening into the inner cavity adjacent to the second end of the unitary body an internal shoulder positioned within the inner cavity;

a first projection that extends from the internal shoulder;

a second projection that extends from the first end of the inner cavity; and the unitary body selectively retains a firearm positioned within the inner cavity, wherein a force is applied to the firearm by the internal shoulder to selectively retain the firearm.

17. A firearm holster comprising:

a unitary body having an inner cavity configured to receive a firearm and a slide cap that partially encloses the inner cavity, the inner cavity having a first end and a second end opposite of the first end with the slide cap being adjacent the first end;

a first opening into the inner cavity adjacent to the first end of the unitary body, wherein the first opening is configured to enable a firearm to be inserted into the inner cavity;

a second opening into the inner cavity adjacent to the second end of the unitary body, wherein the second opening is configured so a portion of a barrel of a firearm and a portion of a slide both extend through the second opening;

an internal shoulder positioned within the inner cavity; and the unitary body selectively retains a firearm positioned within the inner cavity, wherein a force is applied to the firearm by the internal shoulder to push the firearm against the slide cap to selectively retain the firearm.

18. A firearm holster comprising:

a unitary body having an inner cavity configured to receive a firearm, the inner cavity having a first end and a second end opposite of the first end;

a first opening into the inner cavity adjacent to the first end of the unitary body;

a second opening into the inner cavity adjacent to the second end of the unitary body;

an internal shoulder positioned within the inner cavity;

one or more compression pads positioned adjacent to the inner cavity, wherein the one or more compression pads is configured to apply a force against a slide of a firearm positioned within the inner cavity; and the unitary body selectively retains a firearm positioned within the inner cavity, wherein a force is applied to the firearm by the internal shoulder to selectively retain the firearm.

19. The firearm holster of claim 18, further comprising a fulcrum cushion positioned adjacent to the inner cavity, wherein the fulcrum cushion is configured to apply a force against the slide of the firearm positioned within the inner cavity and provide a pivot point for rotation of the firearm within the inner cavity.

20. The firearm holster of claim 19, further comprising a trigger guard wall positioned adjacent to the inner cavity and positioned adjacent to the internal shoulder, wherein the trigger guard wall is configured to apply a force against a trigger guard of the firearm positioned within the inner cavity.

21. The firearm holster of claim 20, further comprising a frame pad positioned adjacent to the inner cavity, wherein the frame pad is configured to apply a force against a frame of the firearm positioned within the inner cavity.

22. The firearm holster of claim 21, further comprising a projection that extends away from the internal shoulder.

23. A firearm holster comprising:

a unitary body having an inner cavity configured to receive a firearm, the inner cavity having a first end and a second end opposite of the first end;

a first opening into the inner cavity adjacent to the first end of the unitary body;

a second opening into the inner cavity adjacent to the second end of the unitary body an internal shoulder positioned within the inner cavity; and the unitary body selectively retains a firearm positioned within the inner cavity, wherein a force is applied to the firearm by the internal shoulder to selectively retain the firearm and wherein the holster is comprised of ethylene vinyl acetate and wherein the EVA is cross-linked EVA and has 50% to 60% proportion of vinal acetate.

* * * * *